US010499132B1

(12) United States Patent
Gao et al.

(10) Patent No.: US 10,499,132 B1
(45) Date of Patent: Dec. 3, 2019

(54) COLORFUL LIGHT MOBILE BLUETOOTH SPEAKER WITH INSTRUMENT HITTING SOUND EFFECT

(71) Applicant: Shenzhen Jinwenhua Speaker Products Co., Ltd., Shenzhen (CN)

(72) Inventors: Xiaojun Gao, Shenzhen (CN); Decheng Xie, Shenzhen (CN)

(73) Assignee: Shenzhen Jinwenhua Speaker Products Co., Ltd., Shenzhen (CN)

( * ) Notice: Subject to any disclaimer, the term of this patent is extended or adjusted under 35 U.S.C. 154(b) by 0 days.

(21) Appl. No.: 16/278,309

(22) Filed: Feb. 18, 2019

(51) Int. Cl.

| | |
|---|---|
| ***H04R 25/00*** | (2006.01) |
| ***H04R 1/02*** | (2006.01) |
| ***F21V 33/00*** | (2006.01) |
| ***H04R 7/16*** | (2006.01) |

(52) U.S. Cl.
CPC ..... *H04R 1/028* (2013.01); *F21V 33/0056* (2013.01); *H04R 1/023* (2013.01); *H04R 7/16* (2013.01); *H04R 2420/07* (2013.01); *H04R 2420/09* (2013.01)

(58) Field of Classification Search
USPC ..... 381/150, 342
See application file for complete search history.

(56) References Cited

U.S. PATENT DOCUMENTS

| | | | | |
|---|---|---|---|---|
| 9,609,435 | B2 * | 3/2017 | Osborn | H04R 5/02 |
| 2016/0192063 | A1 * | 6/2016 | Lee | H04N 5/642 381/306 |
| 2016/0373854 | A1 * | 12/2016 | Han | H04R 1/2834 |
| 2017/0078775 | A1 * | 3/2017 | McGarry | H04R 1/02 |
| 2017/0142513 | A1 * | 5/2017 | Han | H04R 1/2834 |
| 2017/0230739 | A1 * | 8/2017 | Soofer | H04R 1/025 |
| 2018/0035210 | A1 * | 2/2018 | Wang | H04R 5/02 |
| 2018/0063612 | A1 * | 3/2018 | Fuchs | H04R 5/023 |
| 2018/0191930 | A1 * | 7/2018 | Jeong | H04N 5/2252 |
| 2018/0192173 | A1 * | 7/2018 | Graff | H04R 1/025 |
| 2018/0310082 | A1 * | 10/2018 | Amae | H04R 1/021 |
| 2019/0253788 | A1 * | 8/2019 | Pierce | H04R 1/2803 |

* cited by examiner

*Primary Examiner* — Phylesha Dabney

(57) ABSTRACT

The present disclosure discloses a colorful light mobile bluetooth speaker with instrument hitting sound effect, wherein the speaker comprises a front diaphragm mounted on a front housing diaphragm presser, two mutually symmetrical light guide strip boards, and a PCBA/main board, wherein the front housing diaphragm presser is mounted on a front housing and is mounted with horns, the light guide strip boards are disposed on both sides of the PCBA/main board, a horn light transparent member is mounted on the horn, a PCBA/horn light board is mounted on the horn light transparent member the PCBA/main board is disposed behind the front housing diaphragm presser; the speaker also comprises a rear diaphragm fixedly mounted on a rear housing diaphragm presser which is fixedly mounted on a rear housing; and a gravity sensor is mounted in each of the front diaphragm and the rear diaphragm.

11 Claims, 2 Drawing Sheets

COLORFUL LIGHT MOBILE BLUETOOTH SPEAKER WITH INSTRUMENT HITTING SOUND EFFECT

TECHNICAL FIELD

The present disclosure relates to a speaker, in particular to a colorful light mobile bluetooth speaker with instrument hitting sound effect.

BACKGROUND

Bluetooth speakers are used to apply Bluetooth technology to traditional digital and multimedia speakers, allowing users to avoid the annoying wires and listen to music in a variety of ways. Since the advent of bluetooth speakers, with the development of smart terminals, it has been widely concerned by users of mobile phone tablets etc. Bluetooth technology makes the speaker wireless possible, all kinds of well-known brands have launched a variety of "bluetooth speakers" in a variety of shapes, and a super stylish and convenient bluetooth speaker may be very expensive.

Currently, some Bluetooth speakers do not have the instrument hitting sound effect.

SUMMARY

The object of the present disclosure is to provide a colorful light mobile bluetooth speaker with instrument hitting sound effect.

A colorful light mobile bluetooth speaker with instrument hitting sound effect is characterized in that the mobile bluetooth speaker comprises a front diaphragm fixedly mounted on a front housing diaphragm presser, the front housing diaphragm presser being mounted on a front housing, and the front housing is further mounted with horns disposed on both sides of the front diaphragm, two mutually symmetrical light guide strip boards, and a Printed Circuit Board+Assembly (PCBA)/main board, wherein the light guide strip boards are disposed on both sides of the PCBA/main board, wherein a horn light transparent member is mounted on the horn, and a PCBA/horn light board is mounted on the horn light transparent member, and wherein the PCBA/main board is disposed behind the front housing diaphragm presser; the mobile bluetooth speaker comprises a rear diaphragm fixedly mounted on a rear housing diaphragm presser, the rear housing diaphragm presser being fixedly mounted on a rear housing, the rear housing is connected to the front housing, the rear housing and the front housing combine to form a mobile bluetooth speaker housing, and the rear housing diaphragm presser is further provided with a battery mounting frame, a battery being mounted on the battery mounting frame; the mobile bluetooth speaker further comprises a light guide strip mounted on a light transmitting member, the light transmitting member being mounted on the mobile bluetooth speaker housing; and a gravity sensor is mounted in each of the front diaphragm and the rear diaphragm.

Further, a USB board presser is mounted on the rear housing, a PCBA/USB board is mounted on the USB board presser, the PCBA/USB board is electrically connected to the battery, and the battery is an 18650 battery.

Further, a waterproof silicone ring is sleeved on the connection between the rear housing and the front housing, a light guide silicone ring is also fixedly mounted on the front housing, and an LED light guide member is fixedly mounted on the light guide silicone ring.

Further, the mobile bluetooth speaker further comprises a sealing member mounted in a groove, the groove being disposed on the front housing.

Further, the mobile bluetooth speaker further comprises a covering cloth upper sheet and a covering cloth lower sheet, and wherein the covering cloth upper sheet and the covering cloth lower sheet combine to form a covering cloth, and the covering cloth is mounted on the mobile bluetooth speaker housing through a foot pad.

Further, the mobile bluetooth speaker further comprises a rear lid mounted on the mobile bluetooth speaker housing, an edge of the rear lid is in contact with the edge of the covering cloth, and the mobile bluetooth speaker housing is wrapped therein; and the rear lid and the covering cloth each are provided with n sound holes.

Further, the mobile bluetooth speaker further comprises a mesh cloth composed of a front mesh cloth and a rear mesh cloth, the mesh cloth wraps the rear lid and the covering cloth therein, and a nameplate is fixedly mounted on the mesh cloth.

Further, the mobile bluetooth speaker further comprises a press key, which passes through the mesh cloth, the covering cloth upper sheet and the front housing in order, and is connected to a button provided on the PCBA/main board.

Further, the mobile bluetooth speaker further comprises a USB silicone plug and a lanyard fixing member, the USB silicone plug and the lanyard fixing member each are mounted on the rear housing, and the USB silicone plug and the lanyard fixing member each pass through the rear lid and the rear mesh cloth.

Further, the PCBA/main board is electrically connected to the light guide strip, the LED light guide member, the PCBA/horn light board, the front diaphragm, the horn, the light guide strip light board, the battery, and the rear diaphragm, respectively.

The present disclosure provides the beneficial effects that the device has a simple structure with many advantages. For example, the device uses gravity sensors mounted in both the front diaphragm and the rear diaphragm, so that the device can induce different striking accelerations, thereby triggering different instructions; the device receives the instructions triggered by the gravity sensors through the PCBA/main board, then analyzes and calculates the direction and strength, converts them into a sound control signal and a light effect control signal, and sends the signals to a voice chip and a light control circuit, and the voice chip outputs sound signal that is amplified by the power amplifier to drive the speaker to sound, so that the device has the instrument hitting sound effect.

Figure 1:
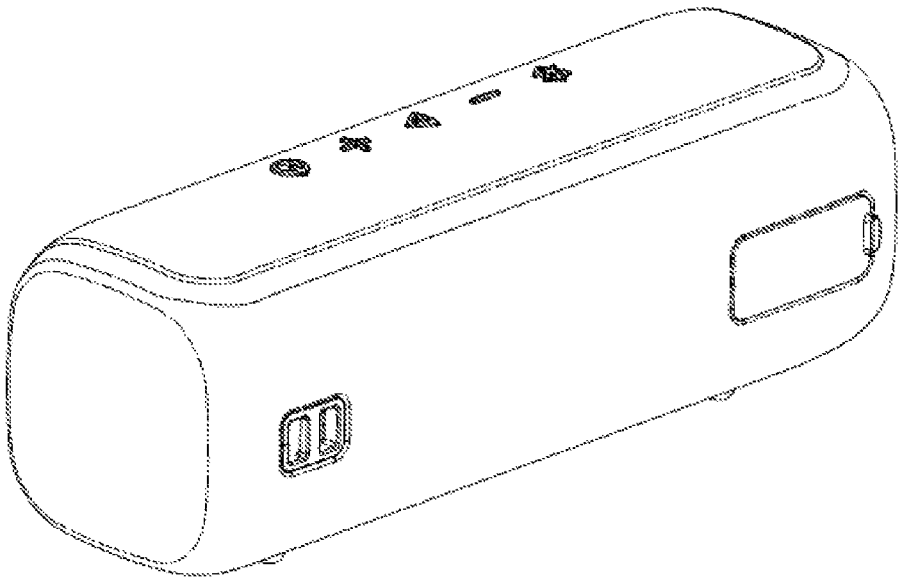
FIG. 1 is a schematic view of a mobile bluetooth speaker according to one embodiment of the present disclosure.
Figure 2:
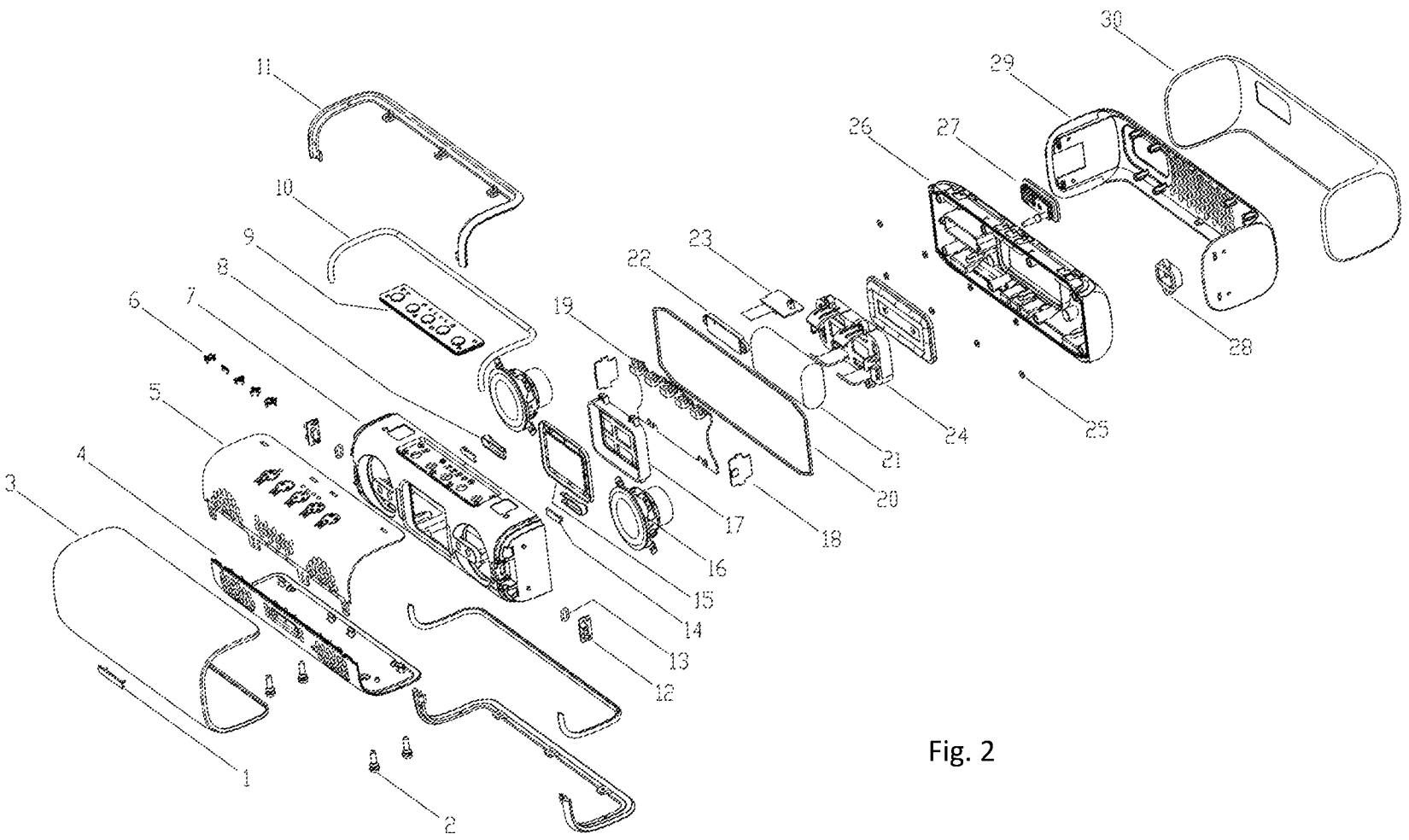
FIG. 2 is a schematic view of an exploded structure of the mobile bluetooth speaker according to one embodiment of the present disclosure.

1—nameplate
2—foot pad
3—front mesh cloth
4—covering cloth lower sheet
5—covering cloth upper sheet
6—press key
7—front housing
8—horn light transparent member
9—sealing member

10—light guide strip
11—light transmitting member
12—LED light guide member
13—light guide silicone ring
14—Printed Circuit Board+Assembly (PCBA)/horn light board
15—front diaphragm
16—horn
17—front housing diaphragm presser
18—light guide strip board
19—PCBA/main board
20—waterproof silicone ring
21—battery
22—USB board presser
23—PCBA/USB board
24—rear housing diaphragm presser
26—rear housing
27—USB silicone plug
28—lanyard fixing member
29—rear lid
30—rear mesh cloth
31—rear diaphragm

DETAILED DESCRIPTION

The following is an embodiment of the present disclosure, but does not limit the scope of the present disclosure.

A colorful light mobile bluetooth speaker with instrument hitting sound effect is characterized in that the mobile bluetooth speaker comprises a front diaphragm 15 fixedly mounted on a front housing diaphragm presser 17, the front housing diaphragm presser 17 being mounted on a front housing 7, and the front housing 7 is further mounted with horns 16 disposed on both sides of the front diaphragm 15, two mutually symmetrical light guide strip boards 18, and a PCBA/main board 19, wherein the light guide strip boards 18 are disposed on both sides of the PCBA/main board 19, wherein a horn light transparent member 8 is mounted on the horn 16, and a PCBA/horn light board 14 is mounted on the horn light transparent member 8, and wherein the PCBA/main board 19 is disposed behind the front housing diaphragm presser 17; the mobile bluetooth speaker comprises a rear diaphragm 31 fixedly mounted on a rear housing diaphragm presser 24, the rear housing diaphragm presser 24 being fixedly mounted on a rear housing 26, the rear housing 26 is connected to the front housing 7, the rear housing 26 and the front housing 7 combine to form a mobile bluetooth speaker housing, and the rear housing diaphragm presser 24 is further provided with a battery mounting frame, a battery 21 being mounted on the battery mounting frame; the mobile bluetooth speaker further comprises a light guide strip 10 mounted on a light transmitting member 11, the light transmitting member 11 being mounted on the mobile bluetooth speaker housing; and a gravity sensor is mounted in each of the front diaphragm 15 and the rear diaphragm 31.

Further, a USB board presser 22 is mounted on the rear housing 26, a PCBA/USB board 23 is mounted on the USB board presser 22, the PCBA/USB board 23 is electrically connected to the battery 21, and the battery 21 is a 18650 battery; the waterproof silicone ring 20 is sleeved on the connection between the rear housing 26 and the front housing 7, a light guide silicone ring 13 is also fixedly mounted on the front housing 7, and an LED light guide member 12 is fixedly mounted on the light guide silicone ring 13; the mobile bluetooth speaker further comprises a sealing member 9 mounted in a groove, the groove being disposed on the front housing 7; the mobile bluetooth speaker further comprises a covering cloth lower sheet 4 and a covering cloth upper sheet 5, wherein the covering cloth lower sheet 4 and the covering cloth upper sheet 5 combine to form a covering cloth, and the covering cloth is mounted on the mobile bluetooth speaker housing through a foot pad 2; the mobile bluetooth speaker further comprises a rear lid 29 mounted on the mobile bluetooth speaker housing, an edge of the rear lid 29 is in contact with the edge of the covering cloth, and the mobile bluetooth speaker housing is wrapped therein; and the rear lid 29 and the covering cloth each are provided with n sound holes; the mobile bluetooth speaker further comprises a mesh cloth composed of a front mesh cloth 3 and a rear mesh cloth 30, the mesh cloth wraps the rear lid 29 and the covering cloth therein, and a nameplate 1 is fixedly mounted on the mesh cloth; the mobile bluetooth speaker further comprises a press key 6, which passes through the mesh cloth, the covering cloth upper sheet 5 and the front housing 7 in order, and is connected to a button provided on the PCBA/main board 19; the mobile bluetooth speaker further comprises a USB silicone plug 27 and a lanyard fixing member 28, the USB silicone plug 27 and the lanyard fixing member 28 each are mounted on the rear housing 26, and the USB silicone plug 27 and the lanyard fixing member 28 each pass through the rear lid 29 and the rear mesh cloth 30; and the PCBA/main board 19 is electrically connected to the light guide strip 10, the LED light guide member 12, the PCBA/horn light board 14, the front diaphragm 15, the horn 16, the light guide strip light board 18, the battery 21, and the rear diaphragm 31, respectively.

According to the present disclosure, a colorful light mobile bluetooth speaker with instrument hitting sound effect is configured, wherein the device has a simple structure with many advantages. For example, the device uses gravity sensors mounted in both the front diaphragm and the rear diaphragm, so that the device can induce different striking accelerations, thereby triggering different instructions; the device receives the instructions triggered by the gravity sensors through the PCBA/main board, then analyzes and calculates the direction and strength, converts them into a sound control signal and a light effect control signal, and sends the signals to a voice chip and a light control circuit, and the voice chip outputs sound signal that is amplified by the power amplifier to drive the speaker to sound, so that the device has the instrument hitting sound effect.

The above is only an embodiment of the present disclosure. It should be noted that those skilled in the art can make other improvements and modifications without departing from the technical principles of the present disclosure. These improvements and modifications should also be considered as falling into the scope of protection of the present disclosure.

What is claimed is:

1. A colorful light mobile bluetooth speaker with instrument hitting sound effect, characterized in that the mobile bluetooth speaker comprises:

a front diaphragm fixedly mounted on a front housing diaphragm presser, the front housing diaphragm presser being mounted on a front housing, and the front housing is further mounted with horns disposed on both sides of the front diaphragm, two mutually symmetrical light guide strip boards, and a Printed Circuit Board+Assembly (PCBA)/main board, wherein the light guide strip boards are disposed on both sides of the PCBA/main board, a horn light transparent member is mounted on the horn, and a PCBA/horn light board is mounted on the horn light transparent member, the PCBA/main board is disposed behind the front housing diaphragm presser; the mobile bluetooth speaker comprises a rear diaphragm fixedly mounted on a rear housing diaphragm presser, the rear housing diaphragm presser is fixedly mounted on a rear housing, the rear housing is connected to the front housing, the rear housing and the front housing are combined to form a mobile bluetooth speaker housing, the rear housing diaphragm presser is further provided with a battery mounting frame, a battery being mounted on the battery mounting frame; the mobile bluetooth speaker further comprises a light guide strip mounted on a light transmitting member, the light transmitting member is mounted on the mobile bluetooth speaker housing; and a gravity sensor is mounted in each of the front diaphragm and the rear diaphragm.

2. The colorful light mobile bluetooth speaker with instrument hitting sound effect according to claim 1, characterized in that a USB board presser is mounted on the rear housing, a PCBA/USB board is mounted on the USB board presser, the PCBA/USB board is electrically connected to the battery.

3. The colorful light mobile bluetooth speaker with instrument hitting sound effect according to claim 2, characterized in that the battery is an 18650 battery.

4. The colorful light mobile bluetooth speaker with instrument hitting sound effect according to claim 1, characterized in that a waterproof silicone ring is sleeved on the connection between the rear housing and the front housing, a light guide silicone ring is also fixedly mounted on the front housing, and an LED light guide member is fixedly mounted on the light guide silicone ring.

5. The colorful light mobile bluetooth speaker with instrument hitting sound effect according to claim 1, characterized in that the mobile bluetooth speaker further comprises a sealing member mounted in a groove, the groove being disposed on the front housing.

6. The colorful light mobile bluetooth speaker with instrument hitting sound effect according to claim 1, characterized in that the mobile bluetooth speaker further comprises a covering cloth upper sheet and a covering cloth lower sheet, wherein the covering cloth upper sheet and the covering cloth lower sheet combine to form a covering cloth, and the covering cloth is mounted on the mobile bluetooth speaker housing through a foot pad.

7. The colorful light mobile bluetooth speaker with instrument hitting sound effect according to claim 6, characterized in that the mobile bluetooth speaker further comprises a rear lid mounted on the mobile bluetooth speaker housing, an edge of the rear lid is in contact with the edge of the covering cloth, and the mobile bluetooth speaker housing is wrapped therein; and that the rear lid and the covering cloth each are provided with n sound holes.

8. The colorful light mobile bluetooth speaker with instrument hitting sound effect according to claim 7, characterized in that the mobile bluetooth speaker further comprises a mesh cloth composed of a front mesh cloth and a rear mesh cloth, the mesh cloth wraps the rear lid and the covering cloth therein, and a nameplate is fixedly mounted on the mesh cloth.

9. The colorful light mobile bluetooth speaker with instrument hitting sound effect according to claim 8, characterized in that the mobile bluetooth speaker further comprises a press key, which passes through the mesh cloth, the covering cloth upper sheet and the front housing in order, and is connected to a button provided on the PCBA/main board.

10. The colorful light mobile bluetooth speaker with instrument hitting sound effect according to claim 1, characterized in that the mobile bluetooth speaker further comprises a USB silicone plug and a lanyard fixing member, the USB silicone plug and the lanyard fixing member each are mounted on the rear housing, and the USB silicone plug and the lanyard fixing member each pass through the rear lid and the rear mesh cloth.

11. The colorful light mobile bluetooth speaker with instrument hitting sound effect according to claim 1, characterized in that the PCBA/main board is electrically connected to the light guide strip, the LED light guide member, the PCBA/horn light board, the front diaphragm, the horn, the light guide strip light board, the battery, and the rear diaphragm, respectively.

* * * * *